United States Patent [19]

Berzenye

[11] Patent Number: 4,736,976

[45] Date of Patent: Apr. 12, 1988

[54] PIPE HOOK

[76] Inventor: Michael L. Berzenye, 15147 Rayneta Dr., Sherman Oaks, Calif. 91403

[21] Appl. No.: 835,161

[22] Filed: Mar. 3, 1986

[51] Int. Cl.[4] ..... B66C 1/14; B66C 1/28

[52] U.S. Cl. ..... 294/82.1; 294/81.56; 294/82.13

[58] Field of Search ..... 294/67.2–67.33, 294/74, 81.1, 81.5, 81.56, 82.1–82.13, 82.17, 82.18, 82.31, 82.36, 87.1; 24/230.5 R

[56] References Cited

U.S. PATENT DOCUMENTS

| | | | |
|---|---|---|---|
| 1,291,437 | 1/1919 | Desch | 294/81.56 X |
| 1,836,576 | 12/1931 | Chalmers | 294/82.1 |
| 2,801,128 | 7/1957 | Washabaugh | 294/67.2 |
| 3,083,991 | 4/1963 | Gale | 294/74 X |
| 3,291,519 | 12/1966 | Burke | 294/67.2 |
| 3,450,428 | 6/1969 | Zimmerman | 294/82.1 |
| 3,606,441 | 9/1971 | Ridgely | 294/82.13 |
| 3,820,195 | 6/1974 | Hutzell | 24/230.5 R X |
| 4,045,072 | 8/1977 | Brown | 294/74 |

FOREIGN PATENT DOCUMENTS

| | | | |
|---|---|---|---|
| 2304145 | 8/1974 | Fed. Rep. of Germany | 294/82.1 |
| 874576 | 10/1981 | U.S.S.R. | 294/82.13 |
| 872430 | 10/1981 | U.S.S.R. | 294/82.1 |
| 935435 | 6/1982 | U.S.S.R. | 294/82.36 |

*Primary Examiner*—Johnny D. Cherry

*Attorney, Agent, or Firm*—Harlan P. Huebner

[57] ABSTRACT

A pipe hook element including a protective boot wherein the material of the boot is resilient and will prevent damage to a pipe being lifted by a pair of pipe hooks through conventional hoisting apparatus. The protective boot is of such a character and shape to be replaceable upon wear and may also include additional protective material of preferably a different material than the boot for use in protecting critical areas of the pipe upon lifting contact.

4 Claims, 2 Drawing Sheets

PIPE HOOK

BACKGROUND OF THE INVENTION

1. Field of the Invention

This invention relates to a pipe hook for use with a crane or hoist with an additional pipe hook for moving pipe from place to place and a hook that employs a protective boot to prevent scarring and injury to the length of pipe being lifted particularly at the ends of the pipes.

2. Description of the Prior Art.

In the field of stevedoring various lengths of pipe usually 20 to 40 foot lengths must be moved onto a vessel for transportation and off the same to an awaiting vehicle or to storage.

Heretofore, pipe end hooks have been used which include metallic hooks which when placed inside the pipe ends will cause scarring, bending and tearing of the pipe as it is lifted because of the pressure of the pipe as it bears against the hook.

Such damage to the ends of pipes requires the expense of not only trimming off the damaged end, but where the pipe was threaded, rethreading may be necessary. Such damage in stevedoring and elsewhere not only has resulted in excessive costs to redo the pipe to present a usage pipe but has caused increased maritime insurance claims which in turn create increased premiums.

In addition, the prior art hooks are preferably made of heavy forged steel, while the pipe material might be aluminum or some soft pliable material which is easily damaged.

SUMMARY OF THE INVENTION

It is a purpose of the present invention to provide a pipe hook for use with hoisting or crane equipment to lift pipe from such as a ship or vehicle where the hook includes a boot or partial cover that actually engages a pipe to be lifted wherein the boot or cover is of a soft material that will cushion the pipe and prevent damage thereto.

Another object of the present invention is to provide a pipe hook that includes a boot that is replaceable as wear develops from lifting pipe.

A further object of the present invention is to provide a pipe hook that may include a boot molded on the pipe hook.

A still further object of the present invention is to provide a pipe hook which includes a protective boot and an additional protective material insert of another material that will act to prevent damage to the pipe as well as have a longer life against wear.

These and other objects and advantages will become apparent from the following part of the specification wherein details have been described for the competence of disclosure, without intending to limit the scope of the invention which is setforth in the appended claims.

BRIEF DESCRIPTION OF THE DRAWINGS

These advantages may be more clearly understood from the following detailed description and by reference to the drawings in which.

DETAILED DESCRIPTION OF THE PREFERRED EMBODIMENT

Figure 9:
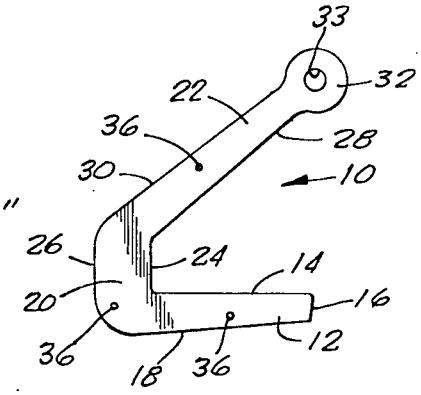
FIG. 9 is a side elevational view of a pipe hook without a protective boot or material thereon.

Now referring more particularly to the drawings, FIG. 9 illustrates a pipe hook or pipe hook element of the present invention generally designated 10. The hook 10 is preferably forged or formed from heavy duty steel and includes a bottom jaw 12 having an interior relatively flat engaging surface 14 projecting inwardly from end 16. The jaw 12 also includes an outer bottom surface 18 projecting inwardly from end 16 and is generally parallel with engaging surface 14.

At the rear of the bottom jaw 12 the hook 10 includes a bridge portion 20 which extends between the bottom jaw 12 and an upper jaw 22. The bridge portion 20 includes an interior engaging surface 24 which is preferably normal to the surface 14 and also includes an exterior surface 26, preferably parallel to the surface 24.

The upper jaw 22 also includes an interior surface 28 which is angled upwardly from the surface 24 and there is an outer upper surface 30 which may be generally parallel with surface 28 or tapers inwardly toward surface 28.

The upper jaw 22 terminates in a shackle receiving end 32 having a shackle bore 33 extending therethrough. In addition the lower or bottom jaw 13 is preferably of a shorter length than said upper jaw 22. The upper jaw 22 also angles away from the plane of the bottom jaw 12.

In the parlance of hoisting hooks, the distance between the bottom jaw 12 and the shackle receiving end 32 is known as the throat. The less distance or throat opening the less diameter pipe, generally designated 34, may be engaged and lifted. However, with the present invention the angulation of the upper jaw 22 over the prior art parallel jaws will allow almost any diameter pipe to be lifted.

Figure 4:
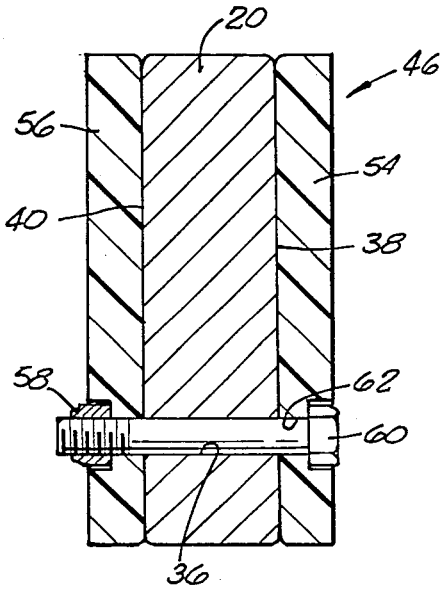
FIG. 4 is a cross-sectional view of the present invention taken on line 4—4 of FIG. 2.

The pipe hook 10 also includes several bores 36 extending through the hook 10 from side 38 to side 40, see FIG. 4. The bores 36 are preferably spaced so that at least one is in the upper jaw, bridge and lower or bottom jaw.

The pipe hook 10 includes a protective boot or sleeve generally designated 46 which can be made of urethane or other types of protective plastic or rubber.

Figure 2:
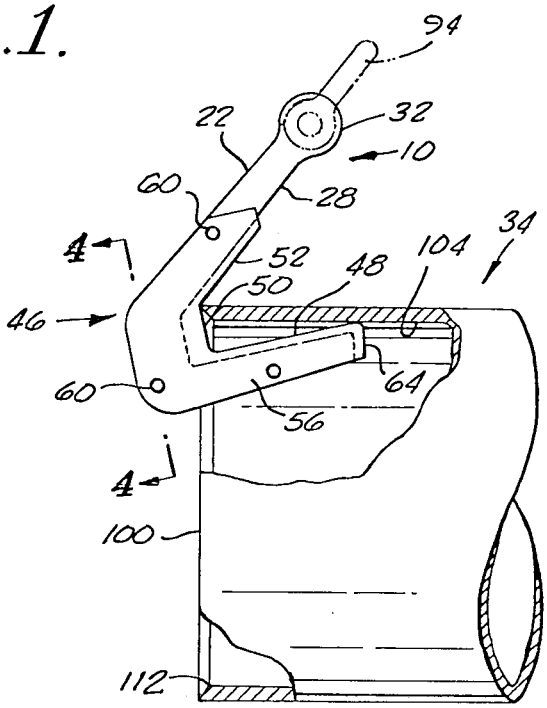
FIG. 2 is a side elevational view of a pipe hook of the present invention in a lifting position.
Figure 7:
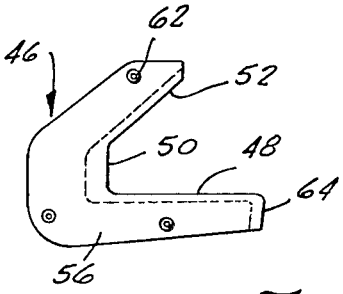
FIG. 7 is a side elevational view of the preferred form of protective boot.

The protective boot 46, see FIGS. 2 and 7 is preferably formed or molded to conform to the shape of the bottom jaw 12, bridge 20 and a portion of the upper jaw 22. The boot or sleeve 46 is U shaped in cross-section, see FIG. 5, and engages the surfaces 14, 24, and 28 of hook 10 and extends over and preferably covers the sides 38 and 40 of the hook 10.

The boot 46 includes inner engaging surfaces 48, 50 and 52 which overfit the surfaces 14, 24, and 28 of the hook 10 and are complementary therewith. The boot 46 also includes parallel sides 54 and 56 that engage sides 38 and 40 of the hook 10.

In the embodiments illustrated the protective boot or sleeve 46 may be removably mounted on the hook 10 by a nut 58 and bolt 60 passing through openings 62. When the boot 46 becomes worn it may be removed and replaced with a new boot 46. In this way the hook 10 can be continued to be reused with the insertion of a new protective boot 46.

While the preferred course of action is to make the boot 46 removable and replaceable, the inventor also contemplates that the boot 46 could be molded directly on the hook 10 without departing from the spirit of the invention.

Figure 1:
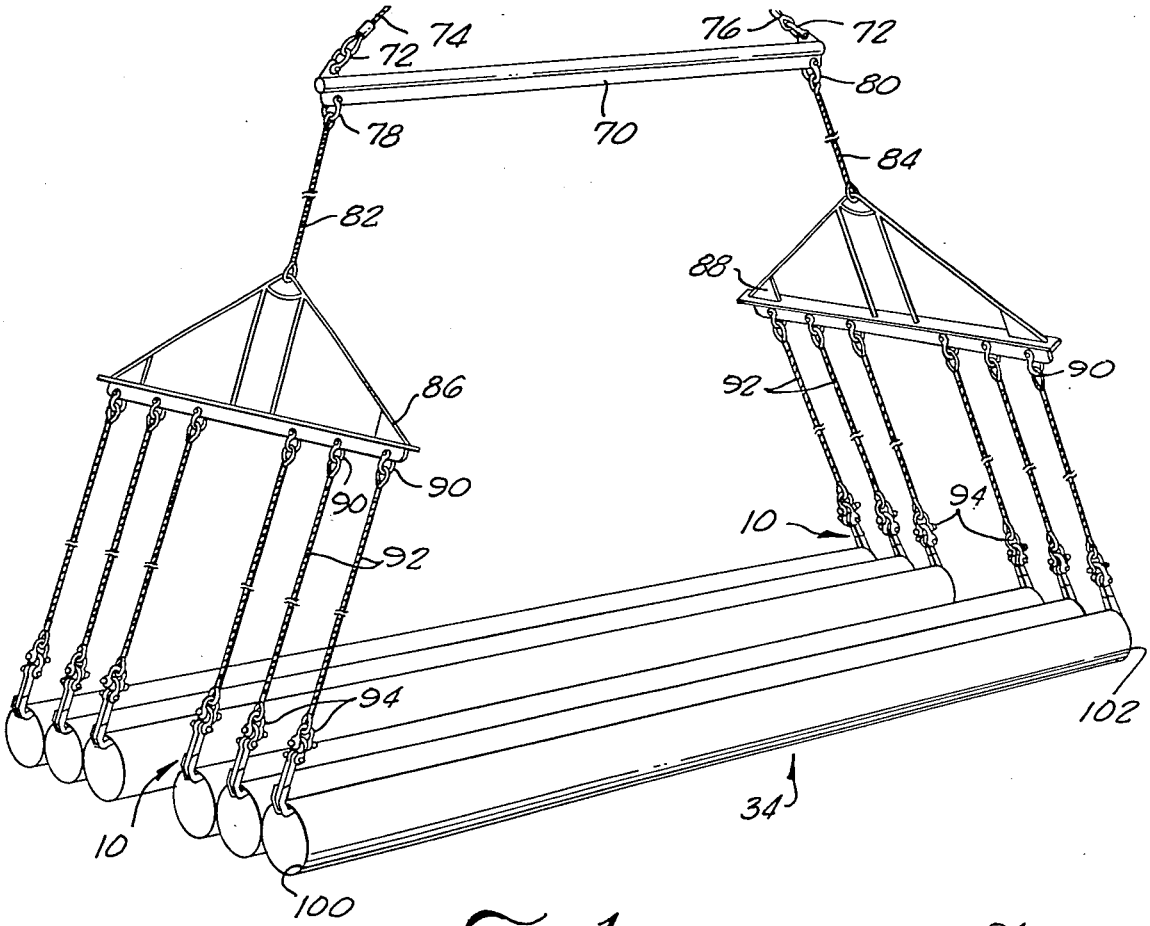
FIG. 1 is a perspective environmental view of the present invention being utilized with additional pipe hooks and hoisting means holding a number of pipes for lifting.

FIGS. 1 and 2 are the best views illustrating the manner in which a plurality of pipe hooks 10 are used. A conventional spreader bar 70 includes conventional upper shackles 72 attached to cables 74 and 76 which extend to a crane or hoist not shown.

Extending downward from the spreader bar 70 at each end from shackles 78 and 80 are spreader suspension cables 82 and 84 which are secured to conventional type cluster bars 86 and 88. The cluster bars 86 and 88 are arranged normal to the elongated axis of the spreader bar 70 and extending downward from shackles 90 are cables 92 with shackles 94 secured through the openings 33 of the shackle receiving end 32 of the pipe hook 10.

In operation, the lower jaws 12 of a pair of pipe hooks 10 are inserted in ends 100 and 102 of a pipe 34. Because the spreader bar 70 is preferably shorter in length than the pipe 34 there will be an inward compression force on the pipe 34 as it is lifted. This will keep the pipe 34 from falling or breaking away from the pipe hook 10, should the pipe hit the sides of a ship or other structure. Preferably the respective length of the spreader bar 70 to the pipe length is such that the angle of the shackle 94, cable 92, and cluster bar 86 will be approximately 45° from the horizontal plane of pipe 34, see FIG. 2.

Further, with the arrangement as described, the point of contact of the protective boot 46 with the interior surface 104 of the pipe 34 is on the inner engaging surface 48 adjacent the end 64 of the boot 46 that covers the jaw end 16. In addition, the inner engaging protective surface that covers the hook engaging surface 24 will bear against the end 100 which is formed by beveling the end as illustrated in FIG. 2.

It can be seen that the fine end 100 of the pipe 34 would be susceptible to inner pressure by the hook 10 and the protective boot 46 will prevent damage thereto. Also the inside 104 of pipe is protected. Thus should the pipe 34 have either exterior or interior threads, damage can be prevented no matter what the weight of the pipe 34 or the malleability of the pipe.

While only a pair of pipe hooks 10 have been described, the cluster bar 86 can provide for a number of pipes 34 to be lifted, such as to and from a ship.

As can be seen with the wear and tear on the boot or cover 46 by the pipe 34, the boot may be removed and a new boot 46 substituted therefor as previously described.

Figure 3:
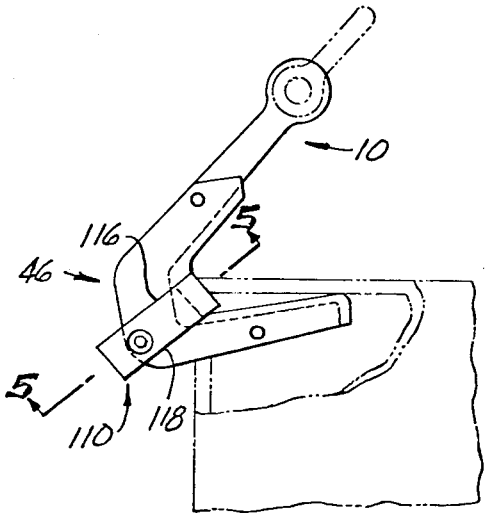
FIG. 3 is a side elevational view of a modified pipe hook employing additional cushioning means.
Figure 5:
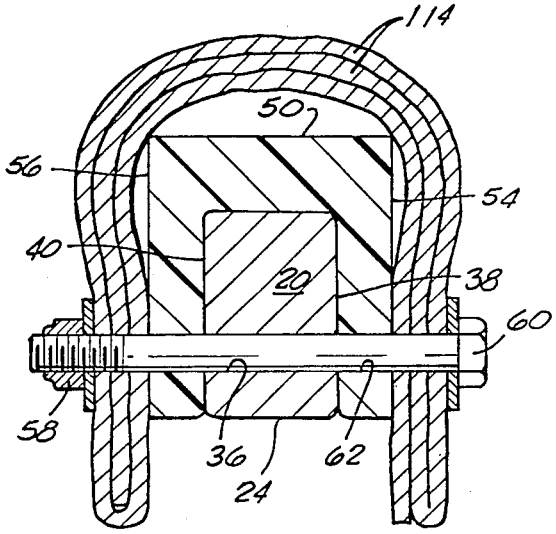
FIG. 5 is a cross-sectional view of the present invention taken on line 5—5 of FIG. 3.

In FIGS. 3 and 5 there is illustrated the hook 10 and protective boot 46; however, there is added at the area of contact with the fine end 100 of the pipe an additional protective belt generally designated 110. Because of the angle of the bevel 112 of the pipe to fine end 100 it may be desired to build up the surface 50 of the boot 46 so that it is angled more such as in FIG. 3.

The protective belt 110 may be a few overlapped layers 114 of protective material such as nylon which will cushion but also assure greater wear before it must be changed.

The layers 114 are formed from an elongated web having generally parallel edges 116 and 118. In practice the web is layered and wrapped around the boot 46 covering the inner engaging surface 50 of the boot and around the sides of the boot. To hold the belt 110 in place the bolt 60 and nut 58 may be employed passing through the bores 62 and 36.

As can be seen the belt of durable protective material such as nylon will further insure protection against damage particularly where the pipe 34 involved is fragile.

Figure 6:
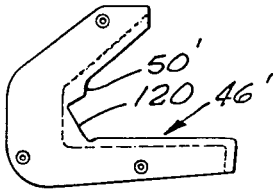
FIG. 6 is a side elevational view of the one form of protective boot employed with a pipe hook of FIG. 3.
Figure 8:
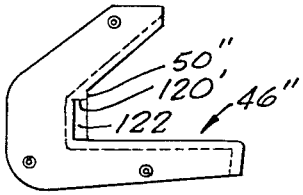
FIG. 8 is a side elevational view of still further form of the protective boot.

FIG. 6 and 8 illustrate further modified protective boots 46' and 46''. The only difference in these structures is that the surface 50' of the boot in FIG. 6 is built up as in FIG. 3 with a recess 120 which can be used to receive an insert (not shown) of protective material yet being prone to wear.

The boot 46'' of FIG. 8 shows a recess 120' in surface 50'' that includes a protective insert 122 of appropriate material to protect the pipe 34. The insert 122 may be affixed in the recess 120' in any convenient manner, particularly in such a way that it may be replaced as well as the boot 46''.

The invention and its attendant advantages will be understood from the foregoing description and it will be apparent that various changes may be made in the form, construction and arrangements of the parts without departing from the spirit and scope thereof of scarificing its material advantages, the arrangements herein before described being merely by way of example. I do not wish to be restricted to the specific forms shown or uses mentioned, except as defined in the accompanying claims, wherein various portions have been separated for clarity of reading and not for emphasis.

I claim:

1. A pipe hook to engage the interior and end of a pipe to be hoisted and moved from one place to another, said pipe hook adopted to be connected to hoisting apparatus, said hook comprising:

a hook element having sides including a lower jaw and an upper jaw longer in length than the length of said lower jaw and angled away from said lower jaw with a bridge therebetween, said jaws and bridge each including interconnected inner relatively flat pipe engaging surfaces and said upper jaw including at the upper end thereof means to connect said hook to said hoisting apparatus;

a protective boot of a resilient material formed on said hook element to prevent damage to said pipe, said boot encompassing said pipe engaging surfaces and said sides of said lower jaw and said bridge; and said boot being releasably secured to said hook element for replacement of the same wherein there are fastening means passing through said boot and said lower and upper jaws of said hook to releasably maintain said boot in position.

2. A pipe hook as defined in claim 1 that includes:

protective belt means of a greater wear quality than said boot and said protective belt means extends around said sides and said inner engaging surfaces adjacent said bridge of said hook element; and fastening means releasably maintaining said protective belt means in position.

3. A pipe hook as defined in claim 1 wherein:

said boot covering said bridge of said hook element is recessed; and a protective material insert is interfitted within said recess which insert has a different wear quality than the material of said boot.

4. A pipe hook as defined in claim 3 wherein said protective material insert is replaceable.

* * * * *